US005335784A

United States Patent [19]

Tyler

[11] Patent Number: 5,335,784

[45] Date of Patent: Aug. 9, 1994

[54] DUMP PLATFORM MATERIALS SCREENER

[75] Inventor: Terry Tyler, West Dummerston, Vt.

[73] Assignee: Tyler and Kerouac Manufacturing and Development, Nashua, N.H.

[21] Appl. No.: 969,778

[22] Filed: Oct. 30, 1992

[51] Int. Cl.[5] ..... B07B 1/28; B07B 1/49

[52] U.S. Cl. ..... 209/260; 209/409; 209/413; 209/420; 37/142.5; 405/179

[58] Field of Search ..... 209/235, 255, 257, 266, 209/260, 315, 325, 409, 413, 420, 404; 37/142.5; 405/179

[56] References Cited

U.S. PATENT DOCUMENTS

| | | | |
|---|---|---|---|
| D. 236,155 | 7/1975 | Lower et al. . | |
| 263,836 | 4/1982 | Read . | |
| 399,486 | 3/1889 | Bradshaw et al. | 209/420 X |
| 1,154,501 | 9/1915 | Foster | 209/413 X |
| 1,218,782 | 3/1917 | Larkin | 209/420 X |
| 1,510,742 | 10/1924 | Gutleben | 209/420 |
| 1,806,934 | 5/1931 | Deister | 209/420 X |
| 1,920,972 | 8/1933 | Deister | 209/403 X |
| 2,276,333 | 3/1942 | Ovestrud | 209/241 X |
| 2,284,692 | 6/1942 | Strube | 209/415 X |
| 2,319,725 | 5/1943 | Drinkwater . | |
| 2,374,775 | 5/1945 | Parks . | |
| 2,983,381 | 5/1961 | Ball . | |
| 3,035,724 | 5/1962 | Clark et al. . | |
| 3,101,314 | 8/1963 | Johnson . | |
| 3,215,408 | 11/1965 | Hansen . | |
| 3,307,698 | 3/1967 | Haffner | 209/420 X |
| 3,439,806 | 4/1969 | Kass et al. | 209/420 X |
| 3,701,422 | 10/1972 | Downey | 209/241 |
| 4,197,194 | 4/1980 | Read | 209/325 |
| 4,222,866 | 9/1980 | Wilson | 209/257 X |
| 4,237,000 | 12/1980 | Read et al. | 209/420 X |
| 4,256,572 | 3/1981 | Read | 209/257 |
| 5,080,860 | 3/1963 | Riccio, Jr. | 209/257 X |
| 5,183,160 | 2/1993 | McClain | 209/420 X |

FOREIGN PATENT DOCUMENTS

| | | | |
|---|---|---|---|
| 1077822 | 11/1954 | France . | |
| 2176423 | 12/1986 | United Kingdom | 209/420 |

OTHER PUBLICATIONS

Telsmith, Specmaker.
Vibro-King.
Seco.
Shaker Buddy Mixer.
Telescreen Super Shredder.

*Primary Examiner*—D. Glenn Dayoan
*Assistant Examiner*—Tuan N. Nguyen
*Attorney, Agent, or Firm*—Daniel J. Bourque

[57] ABSTRACT

A dump platform materials screener includes a horizontally fixed support frame to which is pivotably coupled a materials staging and screening frame. The materials staging and screening frame includes a materials staging area having a bottom region of non-screened material on which may be dumped materials to be screened. A materials screening area adjacent to the non-screened area is provided which extends from the non-screened materials staging area to a first end of the materials staging and screening frame. The materials screening area includes a bottom region including at least one screen having at least a first plurality of openings of at least a first uniform size, for allowing materials to be screened which are of lesser dimensions than that of the uniform size of the plurality of openings to pass through the plurality of openings when the materials to be screened are moved from the materials staging area to the materials screening area. Also included is a materials staging and screening frame incliner, which is actuatable to cause the materials staging and screening frame to move from a first horizontal staging position to a second, inclined screening position.

16 Claims, 5 Drawing Sheets

DUMP PLATFORM MATERIALS SCREENER

FIELD OF THE INVENTION

This invention relates to materials handling equipment and more particularly, to a materials screener employing a dump body or platform which inclines a screening area to achieve materials screening.

BACKGROUND OF THE INVENTION

Materials screeners are used extensively in the landscaping, excavating and materials handling industries to perform such functions as sifting topsoil, separating rocks of different dimensions, and even separating composted materials from compost enhancing materials such as wood chips.

Prior art material screeners suffer from several drawbacks. For example, screeners which employ an inclined screen cannot have an entire front-end bucket loader of material dumped on the screen since the screen is not large enough to process the materials quickly enough and thus, a significant amount of the raw materials will run off the screen, unprocessed. Accordingly, the operator of such a materials screener must slowly dump or release the contents of the raw materials to be screened from the front-end bucket loader onto the vibrating screen.

This process completely ties up the front-end bucket operator and prevents him from retrieving the next bucket load of materials to be screened. Thus, the throughput of the materials screener is significantly impacted and reduced. Moreover, many small portable inclined material screeners such as disclosed in U.S. Pat. Nos. 4,237,000 and 4,197,194 require that the screened material be removed after each bucket of raw material has been processed.

An additional concern is the screening of wet or damp material which may cause "bridges" or blockages in the screen once the materials have been dumped on the screen. Such a problem requires the operator to manually remove the "bridges" or blockages taking a considerable amount of time and greatly affecting screener throughput, while exposing the operator to dangerous moving parts.

In those systems employing an in-feed hopper and in-feed conveyer to supply the raw materials to be screened to a screening deck such as disclosed, for example, in U.S. Pat. No. 3,701,422, such screeners are still restricted in throughput since the screener can only process a limited amount of material at on time. Similar problems of screen "bridging" also exists. An additional drawback is the cost to purchase, maintain, and make available at the site the in-feed hoppers and conveyers to bring materials to the screener.

Finally, all such prior art screeners encounter difficulties when dealing with large objects such as large stones or stumps which are often included in the raw materials to be screened. In order for the prior art screeners to ensure that the screens are not damaged due to these large objects, "grizzly" or "scalping" bars must be provided above the screening area to prescreen or separate these large objects from the remainder of the material to be screened. These "grizzly" or "scalping" bars add further additional expense to the screeners. Additionally, these bars often get blocked with such rocks or stumps. The blocked rocks or stumps must then be manually removed before operation of the screener can continue.

Accordingly, what is needed is a materials screener which can significantly reduce the time required to dump raw materials to be screened on the screener, which ensures that no material will stick to or "bridge" the screen, and which does not require "grizzly" or "scalping" bars to separate the large rocks and stumps from the remainder of the materials to be screened.

SUMMARY OF THE INVENTION

The present invention provides a dump platform materials screener which has an increased materials screening throughput due in part to the ability of the operator to dump substantially all of the materials to be screened from a device such as a front-end bucket loader onto the screener, and which essentially eliminates "bridging" and the need for "grizzly" or "scalping" bars to remove large debris such as stones or stumps prior to the material reaching the screen area. Such a materials screener is provided which is inexpensive and mobile, thus affording the user tremendous flexibility in using the screener for many different types of materials.

Such a dump platform materials screener is provided which includes a horizontally fixed support frame. A materials staging and screening frame is pivotably coupled proximate a first end to a corresponding first end of the horizontally fixed support frame. The materials staging and screening frame is movable between a first horizontal material staging position and a second screening position which is inclined with respect to the first horizontal staging position.

The materials staging and screening frame further includes a materials staging area proximate a second end of the materials staging and screening frame. The materials staging area includes a non-screen region in the bottom of the materials staging and screening frame on which may be dumped large quantities of materials to be screened. The non-screened region may included a stainless steel plate or a steel or similar plate covered with a teflon sheet.

Adjacent to the non-screened area on the materials staging and screening frame is a materials screening area which extends from the non-screened area to the first end of the materials staging and screening frame. The materials screening area includes a bottom region of the materials staging and screening frame having at least one screen. The at least one screen includes at least a first plurality of openings of at least one uniform size for allowing materials to be screened which are of lesser dimensions than the uniform size of the at least first plurality of openings to pass through the openings when the materials to be screened are moved from the staging area to the materials screening area.

Additionally, the present dump platform materials screener includes a materials staging and screening frame incliner, which is coupled between the materials staging and screening frame and the horizontally fixed support frame. The incliner is actuatable in response to actuation of a materials staging and screening frame incliner actuator, for moving the materials staging and screening frame from the first horizontal staging position to the second inclined screening position. Movement of the materials staging and screening frame to the inclined position causes the materials to be screened which are staged on the materials staging area to move from the materials staging area to and across the materials screening area.

Thus, materials screening is accomplished with tremendous throughput utilizing gravity to force the materials to be screened from the staging area onto the screening area. The material to be screened which is of lesser dimension than the predetermined size of the opening of the screen falls through the screen into a collection area beneath the dump platform materials screener, while materials larger than the predetermined size of the openings in the screen are removed from the first end of the screen which is pivotably coupled to the horizontally fixed support frame.

In the preferred embodiment, the materials staging and screening frame further includes first and second side members proximate first and second sides of the materials screening and support frame, for further defining the materials staging area and the materials screening area. Additionally, the materials staging area is adapted to receive essentially all of the materials to be screened generally simultaneously which is preferably at least five cubic yards of the materials to be screened.

The materials to be screened may be delivered to the dump platform materials screener of the present invention by means of a front-end bucket loader.

In the preferred embodiment, the present dump platform materials screener includes a hydraulic pump actuator coupled to a hydraulic pump actuator valve which actuates a hydraulic piston which serves as the materials staging and screening frame incliner to raise and lower the materials staging and screening frame. In such an embodiment, the hydraulic pump actuator is actuatable by a materials delivery device after delivery of the materials to be screened to the materials staging area.

In the embodiment where the materials delivery device is a front-end bucket loader, the hydraulic pump actuator includes a resilient member which is contacted by the front-end loading bucket tractor after delivery of the materials to be screened to the materials staging area. This embodiment also includes a mechanism for automatically de-actuating the hydraulic pump actuator valve once the materials staging and screening frame reaches a predetermined incline angle.

In an alternative embodiment, the hydraulic pump actuator valve is actuatable by a remotely controlled actuator such as a radio frequency transmitter and receiver.

The preferred embodiment of the present dump platform materials screener also includes at least one axle to which is attached at least first and second wheels, for facilitating movement of the dump platform materials screener.

The preferred embodiment also includes one screen having a first plurality of openings of a first uniform size and a second plurality of openings of a second uniform size. In another embodiment, the present dump platform materials screener may also include a first screen including at least a first plurality of openings of a first uniform size, and a second screen, disposed beneath and in spaced relationship to the first screen, and including at least a second plurality of openings of at least a second uniform size.

The preferred embodiment also includes a mechanism to vibrate or shake the materials screen such as a hydraulic vibrator or a shaker having a rotational shaft on which is disposed one or more counter-weights offset from a longitudinal axis which extends through the rotational shaft, which causes a vibrating or shaking motion to occur in the screen.

An additional embodiment also contemplates the use of a materials mover having a number of rotating tines or forks which serve to circulate or move the materials to be screened back towards the material staging area allowing the loosened materials to slide under the rotating times or forks onto the screen area, thus eliminating material blockage or "bridging".

Finally, the present embodiment also includes a plurality of dump platform stabilizers, which are outwardly extendable from the horizontally fixed support frame, for stabilizing the dump platform materials screener when the materials staging and screening frame is in the inclined position.

BRIEF DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
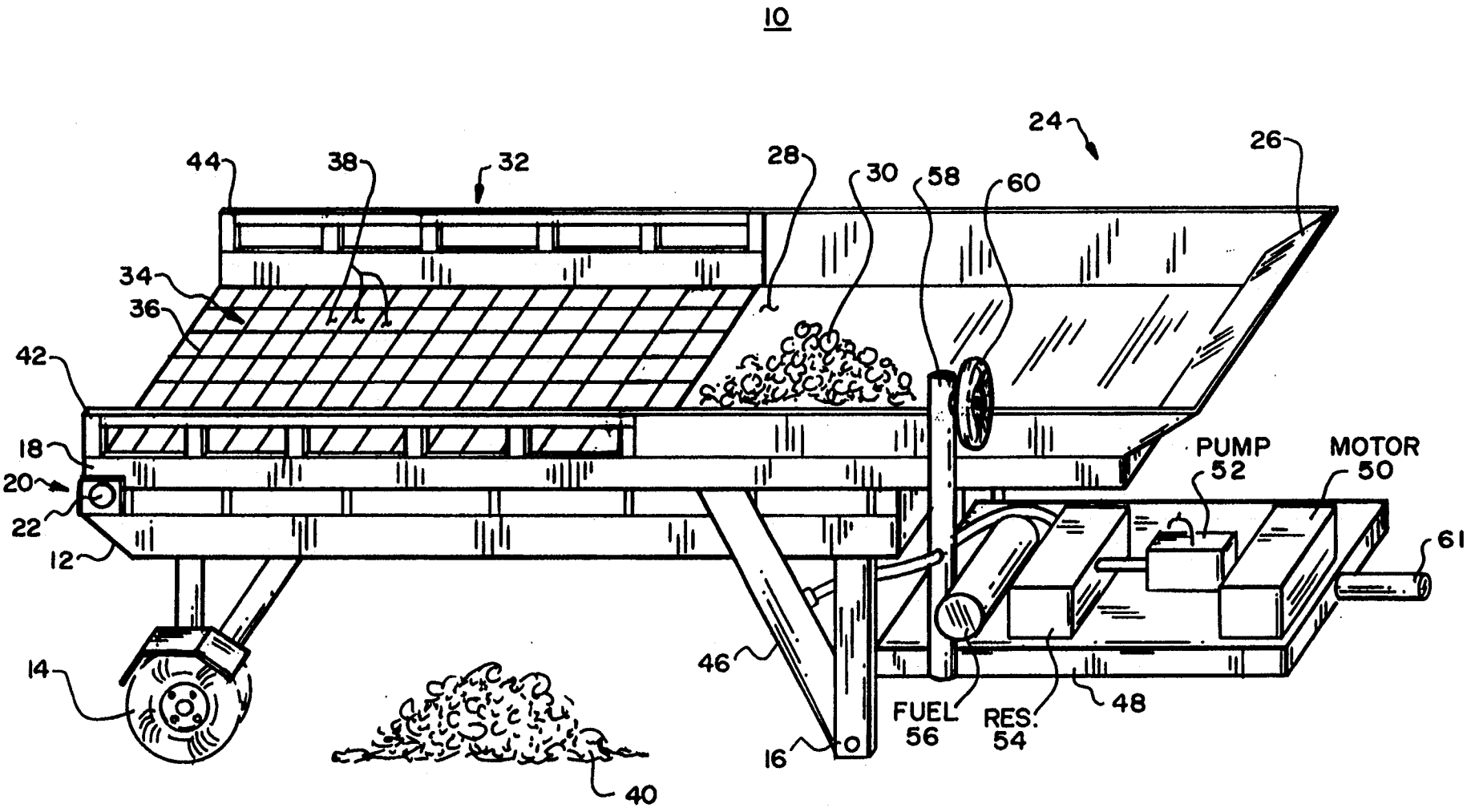
FIG. 1 is a schematic representation of the dump platform materials screener according to the present invention with the materials staging and screening frame in the materials staging or horizontal position.

The preferred embodiment of the dump platform materials screener according to the present invention is shown schematically at 10, FIG. 1, and includes a horizontally fixed support frame 12 which in the preferred embodiment is attached to an axle and wheel assembly 14 to facilitate movement of the dump platform materials screener 10. A pair of horizontally fixed support frame legs 16 (only one shown) opposite the wheel and axle assembly 14 supports and holds the horizontally fixed support frame 12 in the proper horizontal position.

The present dump platform materials screener also includes a materials staging and screening frame 18 which is pivotably coupled proximate a first end 20 to a corresponding first end of the horizontally fixed support frame 12 by means such as pins 22. Thus, by coupling the materials staging and screening frame 18 to the horizontally fixed support frame 12 proximate only one end 20, the materials staging and screening frame 18 may be inclined or pivoted about a longitudinal axis that runs through pivot pins 22.

The materials staging and screening frame 18 includes a materials staging area 24 proximate a second end 26 of the 18 materials staging and screening frame 18. The materials staging area includes a non-screened first bottom region 28 of the materials staging and screening frame on which may be dumped a large quantity of materials to be screened 30.

In the preferred embodiment, the non-screened materials staging area and bottom region 28 is fabricated from a material such as stainless steel or alternatively, a sheet of fabric such as teflon approximately 1/16 to ⅛ inches thick, to facilitate sliding of the materials to be screened from the materials staging area 24 to the materials screening area 32. The materials staging and screening frame 18 also includes a materials screening area 32 which is adjacent to the materials staging area 24, and extends from the non-screened area 28 to the first end 20 of the materials staging and screening frame 18.

The materials screening area 32 includes a second bottom region 34 of the materials staging and screening frame which includes at least one screen 36 having at least a first plurality of openings 38 of at least one uniform size, for allowing materials to be screened which are of lesser dimension than the size of the openings to pass through the openings and into a screened material region 40 beneath the dump platform materials screener 10 once the materials staging and screening frame is moved from the materials staging or horizontal position to the materials screening or inclined position.

In the preferred embodiment, the materials staging area 24 is approximately 12 feet long while the materials screening area 32 is approximately 16 feet long. Materials may be easily removed from the screened materials storage area 40 beneath the dump platform materials screener 10 given that the horizontally fixed support frame 12 is approximately 7 feet above ground level. Thus, screened materials can be removed utilizing a conventional bucket loader or alternatively, a hopper and conveyer assembly (not shown) may be provided to automatically carry away and inventory screened material.

In the preferred embodiment, the dump platform materials screener 10 according to the present invention further includes first and second side members 42 and 44 respectively. The first and second side members are coupled to and perpendicular from the non-screened first bottom region 28 and the screened bottom region 34 of the materials staging and screening frame 18. The first and second side members 42 and 44 are disposed proximate corresponding first and second sides of the materials staging and screening frame 18, for further defining the materials staging area 24 and the materials screening area 32.

Coupled between the horizontally fixed support frame 12 and the pivotable materials staging and screening frame 18 is means for inclining the materials staging and support frame which in the preferred embodiment includes a hydraulic piston 46. In this embodiment, the dump platform materials screener 10 also includes an equipment platform 48 located beneath and protected by the materials staging and support frame staging area 24.

The support equipment frame 48 includes such support equipment as a motor 50 which supplies power to hydraulic pump 52. A hydraulic oil reservoir 54 is coupled to the pump and provides the requisite source of hydraulic fluid to actuate piston 46 as well as any other hydraulic equipment which may be located on the dump platform materials screener. A fuel tank 56 is also provided which supplies the necessary diesel or gasoline fuel to the motor 50.

In the preferred embodiment, motor 50 includes a motor of forty horsepower to operate a 50 gallon per minute 2000 psi pump 52 requiring a 50 gallon oil reservoir 54. Also in the preferred embodiment, piston 46 includes a five stage, 25 ton piston which measures approximately 55 inches long in the closed position. It should be noted that if additional hydraulic equipment is located on the dump platform materials screener such as vibrators, shakers, etc., the motor 50, pump 52, and reservoir 54 must have increased capacities.

The materials staging and screening frame incliner or piston 46 is actuatable in response to the actuation of a hydraulic pump valve. In the preferred embodiment, the hydraulic pump valve actuator includes a vertically movable support member 58 to which is coupled a resilient member such as a rubber tire 60.

To use the present dump platform materials screener, a materials delivery device such as a front-end bucket loader merely drives up to the dump platform materials screener 10, which is located at ground level without the need for dangerous gravel ramps. The front-end bucket loader then dumps all of the material to be screened 30 from its bucket onto the staging area 24 of the dump platform materials screener 10. After dumping all of the material, the front or cutting edge of the bucket will be disposed in a generally vertical position with respect to the ground.

After dumping the material, the front-end bucket loader backs up and uses the front or cutting edge of the bucket to depress resilient member or tire 60 of actuator 58 which in turn actuates hydraulic pump 52 and begins the cycle of raising piston 46 to incline the materials staging and screening frame 18.

As will be described below, the present invention also includes a materials staging and screening frame actuator which automatically resets or lowers the inclined materials screening and staging frame once the frame has reached a predetermined angle of incline.

In order to facilitate mobility of the present dump platform materials screener, the present invention is sized similar to a conventional tractor trailer or approximately 8 feet wide by 40 feet long and includes a coupler 61 for attaching the dump platform materials screener 10 to a towing vehicle such as a tractor or other similar and suitable vehicle.

Figure 2:
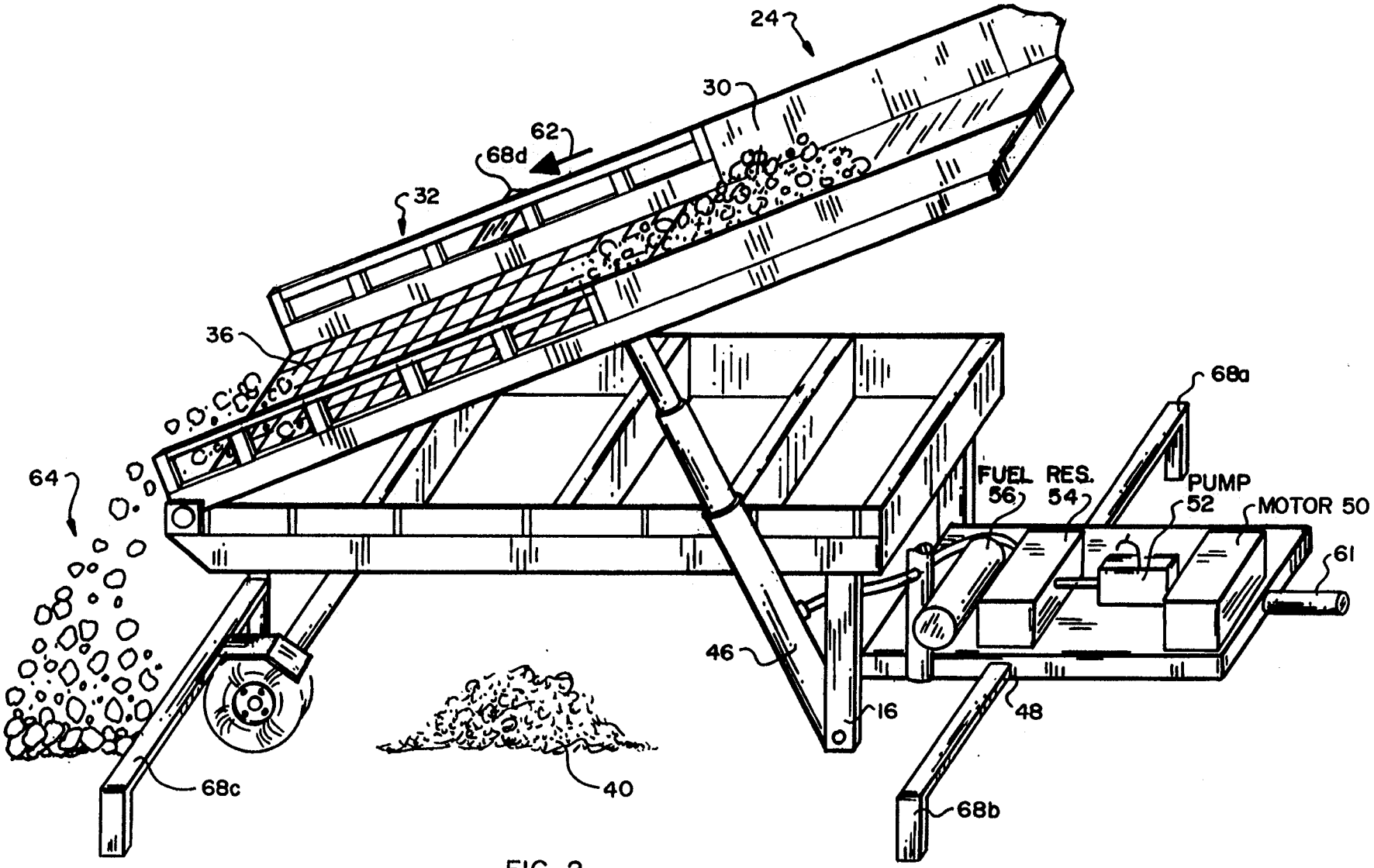
FIG. 2 is a schematic illustration of the dump platform materials screener of the present invention with the materials staging and screening frame in the inclined or screening position.

Operation of the dump platform materials screener of the present invention will now be illustrated in greater detail in conjunction with FIG. 2 which illustrates the materials staging and screening frame 18 in the inclined position after piston 46 has been actuated. In this position, gravity forces the raw materials to be screened 30 downwardly in the direction of arrow 62 over the materials screening area 32. Any material which has a diameter which is less than the size of the predetermined opening in screen 36 will fall into the screened materials recovery area 40 while materials which are larger than the predetermined opening of the screen will fall into a pile 64 behind wheel and axle assembly 14. Thus, when the user has completed the screening process and the screened material has been removed, the user may simply drive away with the dump platform materials screener and leave behind any unwanted or discarded materials.

Utilizing a hydraulic piston to incline the materials staging and screening frame 18 allows the present invention to control the incline position or angle of the materials staging and screening frame 18. Such control is often required to match the dump platform materials screener with the materials being screened. For example, an incline angle of approximately 33° will generally be sufficient to screen gravel, while topsoil may require an angle of approximately 45°. Similarly, compost or other wet materials may require an angle of 45° or more to cause the material to flow over the screened portion of the materials staging and screening frame. Additionally, when screening very wet or compacted materials such as compost, the present invention also contemplates the addition of a materials mover 66 which may include a plurality of hydraulically actuated rotating tines, such as found in rototiller. The tines are spaced a predetermined distance, preferably several inches, above the screen bed and rotate in a counterclockwise direction to move or aerate the material being screened causing the material to flow over the screen region.

As previously described, the incline of the materials staging and screening frame requires the dump platform materials screener of the present invention to include a plurality of stabilizers 68*a*–68*d* which extend approximately 7.5 feet from the frame to assist in stabilizing the dump platform materials screener when the materials staging and screening frame is in the upright position.

Figure 3:
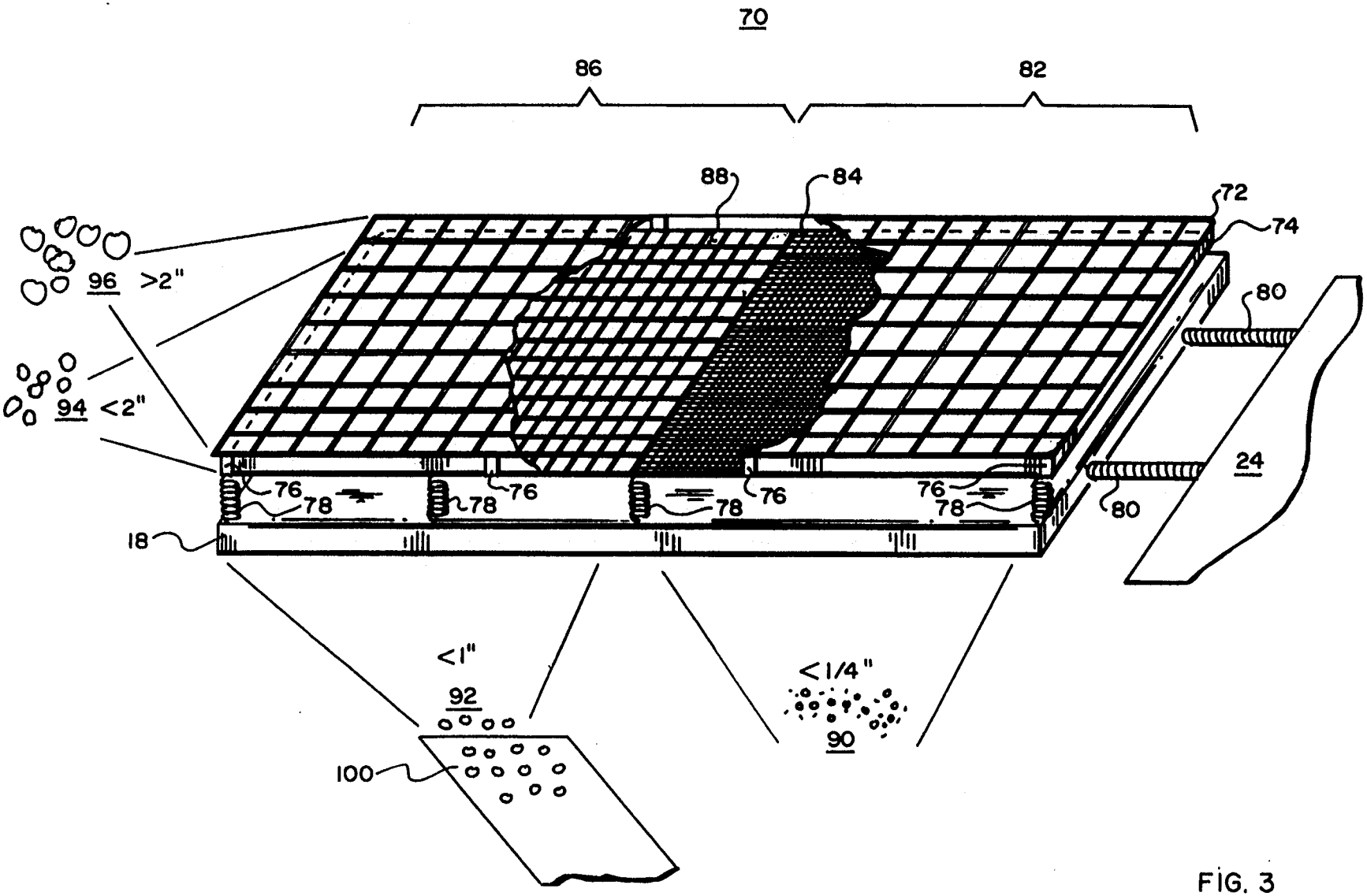
FIG. 3 is a schematic illustration of a double screen area for the dump platform materials screener of the present invention in which one of the screens includes a plurality of openings of two different sizes.

An additional feature of the dump platform materials screener of the present invention is the long (approximately 16 feet) screening area of the materials staging and screening frame. In one embodiment shown in FIG. 3, the materials screening frame 70 may include a first or top screening frame 72 having uniformly spaced screen openings of approximately 2 inches. The first screening frame 72 is mounted in a frame above a second or bottom screening frame 74. Both screening frames are fastened by a metal plate in several areas such as shown generally at 76, and bolted to a main screening frame which sits inside the materials screening frame 18. The first and second frames 72, 74 are mounted to the materials staging and screening frame 18 by means of eight springs 78 (only four on one side are shown). Additionally, the first and second screens 72 and 74 are somewhat restrained in movement when in the inclined position by means of first and second 1 inch cables 80 attached to the non-screened materials staging area 24.

In this embodiment, the second or lower screen 74 includes a first region 82 having a first screen 84 with predetermined openings of approximately ¼ inches, and a second screen region 86 with a screen 88 having predetermined openings of approximately 1 inch. Thus, a dump platform materials screener with dual screens as described herein can produce four finished products namely, a first product in region 90 having a diameter of less than ¼ inch; a second product 92 having a diameter of less than 1 inch; a third product produced in region 94 at the end of the second or lower screen 74 having a diameter of less than 2 inches; and a fourth product having dimensions over 2 inches in region 96 from the end of the first or topmost screen 72. The dump platform materials screener may further include a vibrating or shaking mechanism 79 for causing the screening frames 72, 74 to vibrate or shake. The shaker mechanism 79 may include a hydraulic vibrator or a shaker having a rotational shaft on which is disposed one or more counter-weights offset from a longitudinal axis extending through the shaft.

As previously described, material collection hoppers 98 and conveyers 100 may be provided to remove the material from adjacent the dump trailer materials screener and inventory or stockpile the screened materials some distance away.

As mentioned above, the materials staging and screening frame incliner, preferably a piston, must be actuated after the materials to be screened have been loaded or staged on a materials staging and screening frame.

Figure 4:
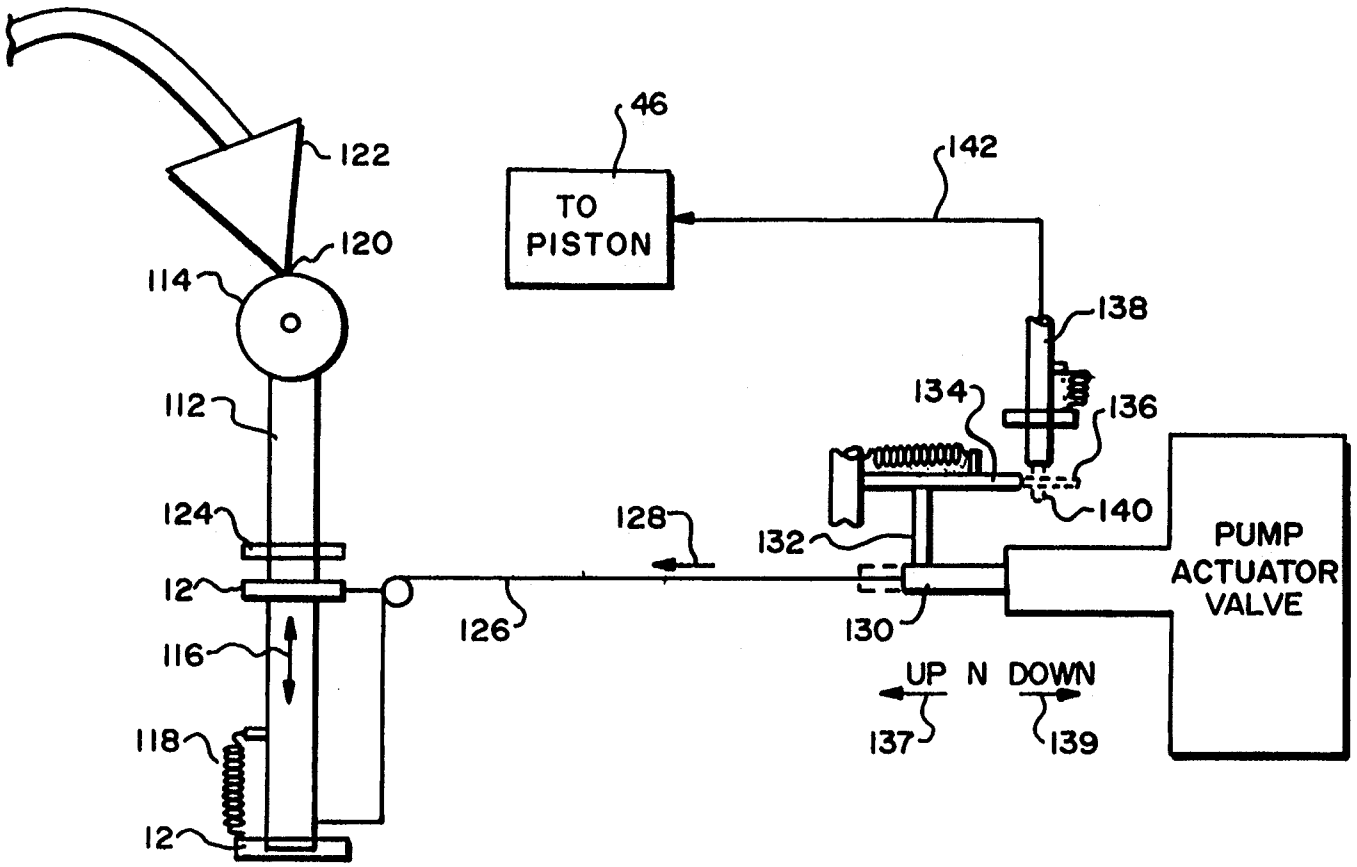
FIG. 4 is a schematic illustration of one embodiment of the materials staging and screening frame incliner actuator assembly which forms part of the dump platform materials screener of the present invention.

An exemplary hydraulic pump actuator assembly 110, FIG. 4, includes a support arm 112 vertically slidably mounted to the horizontally fixed to support frame 12. Support arm 112 includes a resilient member 114, such as a rubber tire, proximate one end. The support arm 112 is adapted for limited vertical movement in the direction shown by arrow 116. A tensioned spring 118 assures that the resilient support arm 112 returns to its upright or unactuated position when not in use.

As previously described, when a materials loading device such as a front-end bucket loader has completed depositing the materials to be screened in the materials staging area, the operator merely 19 reverses or backs up the loader and uses the front or cutting edge 120 of the front-end loader's bucket 122 to depress resilient member or tire 114 which in turn depresses resilient arm 112 up to limiting plate 124. Depressing resilient arm 112 causes cable 126 to be pulled in the direction shown by arrow 128 which in turn pulls pump actuator valve arm 130 from its normal neutral or down position which allows the piston to compress or remain in the neutral position, to the up position which causes hydraulic fluid to flow into the piston thus raising it.

Coupled to pump actuator valve arm 130 is cross member 132 which in turn is coupled to automatic release assembly arm 134 which is normally biased in the closed position as shown by dashed lines 136. Once the pump actuator valve arm has been pulled or actuated which in turn moves the automatic release assembly arm from the first position 136 to the second position 134, a plunger member 138 is released causing plunger member 138 to extend downwardly as shown by dashed lines 140 thus preventing automatic release assembly arm 134 from returning the pump actuator valve arm 130 to the down position 139.

Plunger assembly 138 is coupled by means of cable 142 to the piston casing 46. When the piston reaches a predetermined angle, the piston pulls on cable 142 which in turn retracts plunger 138 and allows automatic release arm 134 to return to the position shown by dashed lines 136. This in turn causes the pump actuator valve arm 130 to return to the down position 139 causing the pump actuator valve to suspend providing hydraulic fluid to the piston, thus allowing the piston to compress and the materials staging and screening frame to return to the horizontal position. All cables are fully adjustable by means such as turnbuckles to allow the system to be properly tuned for the desired results.

Figure 5:
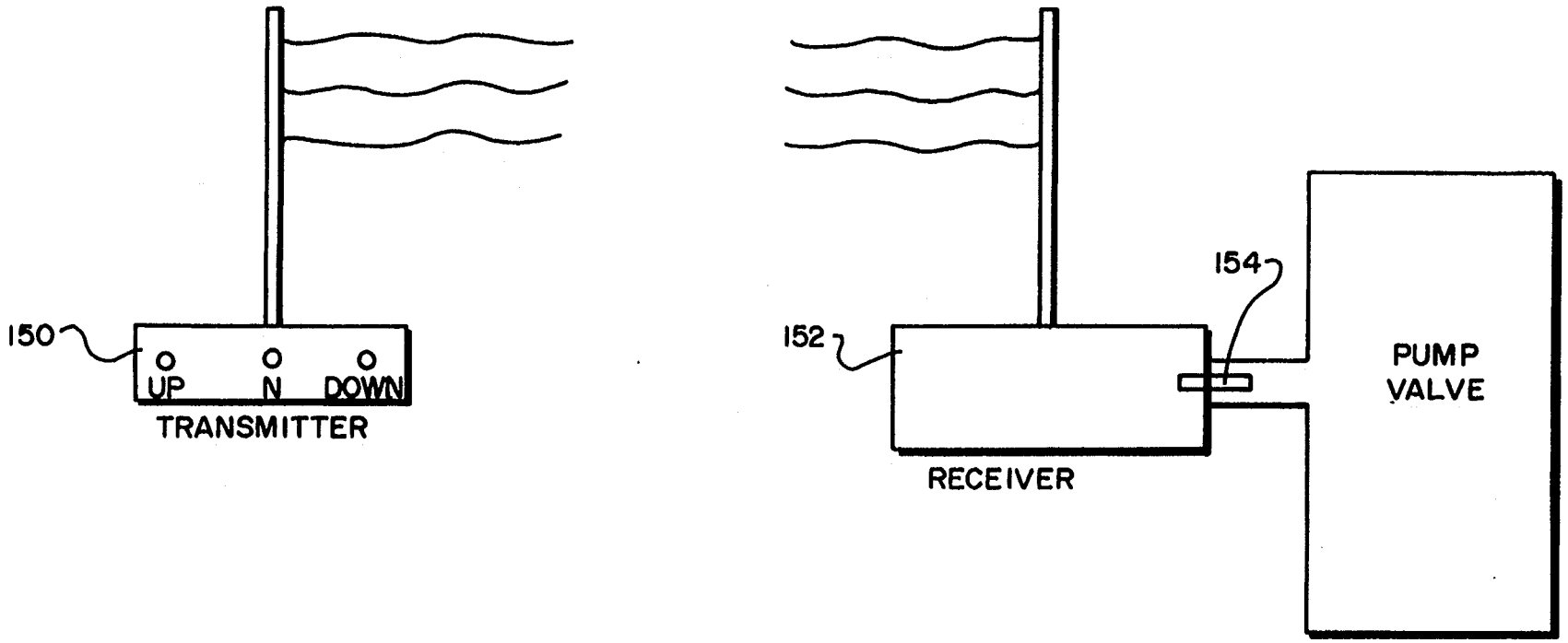
FIG. 5 is an alternate embodiment of a materials staging and screening frame incliner actuator according to the another embodiment of the present invention.

Alternatively, a remotely actuated materials staging and screening frame incliner actuator may be provided as shown in FIG. 5 which includes a radio frequency transmitter 150 having an up, neutral and down electronic panel which operates and electric valve and 2 flow valves. The transmitter signals which are received by an electronic radio frequency receiver in panel 152 which in turn controls the pump valve actuator member 154 to actuate, de-actuate, or place the hydraulic pump valve in a neutral position.

Although some features of the present invention are shown in conjunction with other features, it is understood that each and every feature of the present invention may be combined with other features without departing from the scope of the present invention. Additionally, modifications and substitutions by one of ordinary skill in the art are considered to be within the scope of the present invention which is not to be limited except by the claims which follow.

What is claimed is:

1. A dump platform materials screener, comprising:

a horizontally fixed support frame;

a materials staging and screening frame, pivotably coupled proximate a first end to a corresponding first end of said horizontally fixed support frame, said materials staging and screening frame movable between a first horizontal material staging and screening frame movable between a first horizontal material staging position to at least a second screening position, said at least a second screening position inclined with respect to said horizontal staging position;

said materials staging and screening frame including:

a materials staging area proximate a second end of said materials staging and screening frame, said materials staging area including a non-screened first bottom region of said materials staging and screening frame on which materials to be screened are dumped when said materials staging and screening frame is in said first horizontal material staging position; and a materials screening area, adjacent to said non-screened area and extending from said non-screened area to said first end of said materials staging and screening frame, said materials screening area including a second bottom region of said materials staging and screening frame, said second bottom region including at least one screen having at least a first plurality of openings of at least one uniform size, for allowing materials to be screened which are of lesser dimension than said at least one uniform size of at least first plurality of openings to pass through said at least first plurality of openings when said materials to be screened are moved from said materials staging area to said materials screening area; and a materials staging and screening frame incliner, including a hydraulic piston coupled between said materials staging and screening frame and said horizontally fixed support frame, and actuatable in response to actuation of a materials staging and screening frame incliner actuator including a hydraulic pump actuator valve, for moving said materials staging and screening frame from said first horizontal staging position to said at least a second inclined screening position, said at least a second inclined screening position causing said materials to be screened which are staged on said materials staging area to move from said materials staging area to said screening area, wherein said hydraulic pump actuator valve is actuatable by a remotely controlled hydraulic pump actuator valve.

2. The materials screener of claim 1 wherein said materials staging and screening frame further includes first and second side members, coupled to and perpendicular from said non-screened first bottom region and said screened second bottom region of said materials staging and screening frame, said first and second side members disposed proximate corresponding first and second sides of said materials staging and screening frame, for further defining said materials staging area and said materials screening area.

3. The materials screener of claim 1 wherein said materials staging area is adapted to receive from a materials delivery device all of said materials to be screened carried by said device generally simultaneously.

4. The materials screener of claim 3 wherein said materials staging area is adapted to receive at least five cubic yards of said materials to be screened generally simultaneously.

5. The materials screener of claim 1 wherein said materials staging and screening frame incliner actuator includes means for automatically de-actuating said hydraulic pump actuator valve.

6. The materials screener of claim 1 wherein said remotely controlled actuator includes a radio frequency transmitter and receiver.

7. The materials screener of claim 1 wherein said dump platform materials screener is mobile, and includes at least one axle to which is attached at least first and second wheels, for facilitating movement of said dump platform materials screener.

8. The materials screener of claim 1 wherein said at least one screen includes a first plurality of openings of a first uniform size, and a second plurality of openings of a second uniform size.

9. The materials screener of claim 1 wherein said materials screening area includes a first screen having a first plurality of openings of a first uniform size, and a second screen, disposed beneath and in spaced relationship to said first screen, said second screen including a plurality of openings of a second uniform size.

10. The materials screener of claim 1 wherein said dump platform materials screener further includes means for shaking said at least one screen.

11. The materials screener of claim 10 wherein said means for shaking includes a shaker having at least a rotational shaft to which is coupled at least one counter weight offset from a longitudinal axis extending through said rotational shaft.

12. The materials screener of claim 1 further including means for moving said materials to be screened over said screening area.

13. The materials screener of claim 1 further including a plurality of stabilizers, outwardly extendable from said horizontally fixed support frame, for stabilizing said dump platform materials screener when said materials staging and screening frame is in said inclined position.

14. A dump platform materials screener, comprising:

a horizontally fixed support frame;

a materials staging and screening frame, pivotably coupled proximate a first end to a corresponding first end of said horizontally fixed support frame, said materials staging and screening frame movable between a first horizontal material staging and screening frame movable between a first horizontal material staging position to at least a second screening position, said at least a second screening position inclined with respect to said horizontal staging position;

said materials staging and screening frame including:

a materials staging area proximate a second end of said materials staging and screening frame, said materials staging area including a non-screened first bottom region of said materials staging and screening frame on which materials to be screened are dumped when said materials staging and screening frame is in said first horizontal material staging position; and a materials screening area, adjacent to said non-screened area and extending from said non-screened area to said first end of said materials staging and screening frame, said materials screening area including a second bottom region of said materials staging and screening frame, said second bottom region including at least one screen having at least a first plurality of openings of at least one uniform size, for allowing materials to be screened which are of lesser dimension than said at least one uniform size of at least first plurality of openings to pass through said at least first plurality of openings when said materials to be screened are moved from said materials staging area to said materials screening area; and a materials staging and screening frame incliner including a hydraulic piston, coupled horizontally fixed support frame, and actuatable in response to actuation of a materials staging and screening frame incliner actuator including a hydraulic pump actuator valve, for moving said materials staging and screening frame from said first horizontal staging position to said at least a second inclined screening position, said at least a second inclined screening position causing said materials to be screened which are staged on said materials staging area to move from said materials staging area to said screening area, wherein said hydraulic pump actuator valve is actuatable by a materials delivery device after delivery of said materials to be screened to said materials staging area.

15. The materials screener of claim 14 wherein said materials delivery device includes a front-end-bucket loading tractor.

16. The materials screener of claim 15 wherein said materials staging and screening frame incliner actuator includes a resilient member; and wherein said front-end-bucket loading tractor contacts said resilient member to actuate said materials staging and screening frame incliner after delivery of said materials to be screened to said materials staging area.

* * * * *